US006746384B2

(12) United States Patent
Cole et al.

(10) Patent No.: US 6,746,384 B2
(45) Date of Patent: Jun. 8, 2004

(54) APPARATUS FOR EXERCISING THE MUSCLES OF THE LUMBAR REGION OF THE BACK

(75) Inventors: Brian Cole, Newport News, VA (US); Wayne A. MacMasters, Hampton, VA (US)

(73) Assignee: Maccole Enterprises, L.L.C., Newport News, VA (US)

( * ) Notice: Subject to any disclaimer, the term of this patent is extended or adjusted under 35 U.S.C. 154(b) by 182 days.

(21) Appl. No.: 09/835,633

(22) Filed: Apr. 16, 2001

(65) Prior Publication Data

US 2003/0166440 A1 Sep. 4, 2003

(51) Int. Cl.[7] ..... A63B 21/00

(52) U.S. Cl. ..... 482/130; 482/142; 482/907

(58) Field of Search ..... 297/451.4, 451.5, 297/217.1, 187; 482/130, 142, 140, 148, 907, 111, 112

(56) References Cited

U.S. PATENT DOCUMENTS

| | | | | |
|---|---|---|---|---|
| 4,113,250 A | | 9/1978 | Davis | |
| 4,462,252 A | | 7/1984 | Smidt et al. | |
| 4,492,236 A | | 1/1985 | Pile | 128/781 |
| 4,565,368 A | | 1/1986 | Boettcher | |
| 4,583,731 A | | 4/1986 | Crivelo et al. | |
| 4,696,291 A | | 9/1987 | Tyo | 128/78 |
| 4,702,108 A | | 10/1987 | Amundsen et al. | 73/379 |
| 4,725,054 A | | 2/1988 | Solow et al. | |
| 4,732,381 A | | 3/1988 | Skowronski | |
| 4,768,779 A | | 9/1988 | Oehman et al. | |
| 4,783,121 A | | 11/1988 | Luyk et al. | 297/300 |
| 4,802,462 A | | 2/1989 | Reiss et al. | 128/25 |
| 4,805,455 A | | 2/1989 | DelGiorno et al. | 73/379 |
| 4,824,103 A | | 4/1989 | Smidt | |
| 4,838,249 A | | 6/1989 | Jannotta | 128/25 |
| 4,893,808 A | | 1/1990 | McIntyre et al. | 272/94 |
| 4,893,813 A | | 1/1990 | Murray et al. | 272/145 |
| 4,902,009 A | | 2/1990 | Jones | 272/134 |
| 5,007,634 A | | 4/1991 | Jones | 272/134 |
| 5,037,090 A | * | 8/1991 | Fitzpatrick | |
| 5,070,863 A | * | 12/1991 | McArthur et al. | |
| 5,094,249 A | | 3/1992 | Marras et al. | 128/781 |
| 5,256,126 A | | 10/1993 | Grotstein | 482/142 |

(List continued on next page.)

*Primary Examiner*—Jerome W. Donnelly
(74) *Attorney, Agent, or Firm*—George F. Helfrich; Larry J. Guffey

(57) ABSTRACT

An apparatus for exercising the muscles of the lumbar region of a subject's back includes a seat, a vertical support member to which the back end of the seat is attached so that the centerline extending from the from the front to the back of the seat forms an angle with the vertical member in the range of 65 to 75 degrees and with the front end of the seat being inclined downward to the surface on which the vertical support member stands, a base attached to the bottom end of the vertical support member, a cylindrical roller pad that is rotatably mounted to the vertical support member at a position above the seat, a knob that is adjustably mounted to the vertical support member, and a hand-held weight which the subject grasps and holds near the subject's body while performing the strengthening exercises. In a first embodiment, these entail the subject sitting on the seat and assuming a first position with subject's upper torso bent over so as to be proximate the thighs and a hand-held weight grasped and held near the subject's chest. The subject then moves to a second position by raising the upper torso while continuing to hold the hand-held weight near the subject's chest and keeping the pelvis and sacrum in contact with the pad. A preferred angular range of motion of the subject's back while so exercising is approximately seventy-two degrees. In a second embodiment, the exercises entail the subject standing with a hand-held weight near the hip and with the sacrum against the knob so as to keep the hips and pelvis from moving while the subject does lateral, upper body bending exercises.

16 Claims, 5 Drawing Sheets

U.S. PATENT DOCUMENTS

| | | | | | |
|---|---|---|---|---|---|
| 5,380,269 | A | | 1/1995 | Urso | 602/19 |
| 5,403,258 | A | | 4/1995 | Hill | 482/192 |
| 5,474,086 | A | | 12/1995 | McCormick et al. | 128/782 |
| 5,496,247 | A | | 3/1996 | Anderson | 482/142 |
| 5,551,935 | A | | 9/1996 | Pustaver et al. | 482/142 |
| 5,554,086 | A | * | 9/1996 | Habing et al. | |
| 5,730,688 | A | | 3/1998 | Prusick | 482/130 |
| 5,762,585 | A | | 6/1998 | Jones | 482/8 |
| 5,928,112 | A | | 7/1999 | Jones et al. | 482/8 |
| 6,004,246 | A | | 12/1999 | Sencil | 482/96 |
| 6,228,000 | B1 | | 5/2001 | Jones | 482/8 |
| 6,354,982 | B1 | | 3/2002 | Sencil | 482/96 |

* cited by examiner

APPARATUS FOR EXERCISING THE MUSCLES OF THE LUMBAR REGION OF THE BACK

CROSS-REFERENCE TO RELATED APPLICATIONS

This application is related to U.S. Provisional Patent Application No. 06/241,726, filed Oct. 19, 2000 and entitled "Device For Exercising The Muscles Of The Lumbar Region Of The Back," and submitted by applicants Brian Cole and Wayne A. MacMasters. The teachings of this application is incorporated herein by reference to the extent that they do not conflict with the teaching herein.

BACKGROUND OF THE INVENTION

1. Field of Invention

The present invention generally relates to equipment for measuring and testing muscle forces. More particularly, this invention relates to equipment for exercising the muscles of the lumbar region of the back.

2. Description of the Related Art

The concept of resistance for exercising individual muscles or muscle groups is generally known. Various techniques, such as "sit ups", abdominal "crunches", "push-ups" and "pull-ups" utilize the weight or resistance of the body itself to provide such benefit. Free weights, in the form of barbells and dumbbells have long been used for such purposes. Likewise, various weight training or resistance devices have been developed for such purposes. For example, the following U.S. patents generally disclosed devices and methods for exercising the muscles of the back: U.S. Pat. No. 4,583,731—Spinal Exercising Apparatus, U.S. Pat. No. 4,666,152—Lower Back Exercising Machine, U.S. Pat. No. 4,838,249—Lower Back Therapy Device, U.S. Pat. No. 4,893,813—Back Exercise Device, U.S. Pat. No. 5,171,201—Back Exercise Device, U.S. Pat. No. 5,256,126—Abdominal and Back Exercising Device, U.S. Pat. No. 5,380,269—Back Treatment Device, U.S. Pat. No. 5,403,258—Abdominal And Lumbar Therapy And Exercise Apparatus, U.S. Pat. No. 5,496,247—Back Builder, U.S. Pat. No. 5,551,935—Exercise Device For the Lower Back, and U.S. Pat. No. 5,730,688—Portable Abdominal-Lumbar Exercise Device.

Clinical medical studies have demonstrated the effectiveness of mechanically-aided exercise in situations where the pelvis is fixed in a position which allows the person's back or spine to be exercised from flexion to extension. Devices for such purposes, include lumbar extension machines and torso rotation machines, both of which are available from the MedX Corporation and others. Such machines are extremely complex. In general, their complexity, size, expense and the need for a technician's assistance to use the equipment does not render them readily susceptible to individual purchase and use. Additionally, some of these units do not isolate the lumbar paraspinal or lateral flexor musculature because they lack pelvic stabilization or do not provide progressive resistance.

While all of the referenced prior art relates, in some respect, to exercise of certain muscle groups by providing a means of resistance to movement through a certain range of motion, such inventions are directed primarily toward one particular muscle group and are further directed to resistance to either a pushing type of muscle motion or a pulling resistance mechanism which seems to have found particular favor in devices relating to abdominal muscle groups.

Exercise of the lower back muscle group has become particularly important in the rehabilitation of back injuries and in physical therapy designed to promote recovery and to prevent recurrence. Machines typically utilized for these purposes are, for the most part, extremely expensive, do not stabilize the pelvis or isolate the lumbar paraspinals or lateral flexors, and usually are available only in rehabilitation centers, medical facilities and health clubs. The expense of such machines does not often render them economically feasible for individual use outside of those settings.

Accordingly, a need exists for a device for exercising with progressive resistance the lower back muscle group of the human torso while the pelvis is stabilized, with such a device being easily used without a technician's assistance and being relatively inexpensive to purchase and maintain. Specifically, what is needed is a device which may be used to exercise, with progressive resistance and without assistance, the lower back muscles, with the device not being expensive and utilizing a minimum number of moving parts for safety considerations and ease of maintenance.

SUMMARY OF THE INVENTION

The present invention is directed to an exercise apparatus that is specifically directed to the human torso and exercise of the lumbar (extensor) paraspinal and lateral flexor (quadratus lumborum) muscles of the lower back. More specifically, this invention is directed to a torso exercising apparatus which one utilizes to exercise his or her lower back muscles.

In a first embodiment, the apparatus of the present invention comprises a seat on the top of which a subject sits while performing lumbar region strengthening, progressive resistance exercises. This seat is mounted at a downward angle of in the range of sixty-five to seventy-five degrees to an inner vertical support member which is slidably mounted within the top end of a hollow, outer vertical support member so as to allow the seat to be oriented at various elevations above the outer vertical support member's top end so as to accommodate subject's of various heights. To this inner vertical support member and above its seat is adjustably mounted a cylindrical roller pad. The elevation of this pad is adjusted so that a subject sitting on the seat can slide back on the seat and roll the pad into contact with the subject's sacrum and pelvis so as to limit any extension at the hip joint while performing the lumbar extension strengthening exercises. A footplate is attached to the outer vertical support member's base and is used by the subject to hold the feet stationary while the subject sits on the seat and uses the legs to push the hips backward so that the subject's pelvis and sacrum stay in contact with the roller pad while performing progressive resistance, strengthening exercises.

These exercises entail the subject sitting on the inclined seat and assuming a first position with subject's upper torso bent over so as to be proximate the thighs, with a hand-held weight having been grasped and held near the subject's chest. The subject then moves to a second position by raising the subject's upper torso while holding the hand-held weight near the subject's chest and keeping the subject's pelvis and sacrum in contact with the roller pad. The angular range of motion of the subject's lumbar region, while so exercising, is in the range of fifty to eighty degrees, which includes a preferred seventy-two degrees range of angular motion; this range having been set by orienting the front of the seat downward so as to fix the position and angle of the subjects thighs with respect to the horizontal.

In a second embodiment, the apparatus further comprises a knob that is adjustably mounted to the inner vertical support member. This knob is so configured as to aid a subject who stands with the sacrum against the knob from moving the hips and pelvis while doing lateral, upper body bending exercises.

Thus, there has been summarized above, rather broadly, the more important features of the present invention in order that the detailed description that follows may be better understood and appreciated. There are, of course, additional features of the invention that will be described hereinafter and which will form the subject matter of any eventual claims to this invention.

In this respect, before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is therefore an object of the present invention to provide an apparatus for exercising the lower back muscle group of the human torso.

It is another object of the present invention to provide an apparatus for exercising the muscles of the lumbar region of the back that is relatively inexpensive to purchase and maintain, and which does not require a technician to assist one in using the apparatus.

It is yet another object of the present invention to provide an apparatus for exercising with progressive resistance the muscles of the lumbar region of the back.

It is also an object of the present invention to provide an apparatus for exercising with progressive resistance the muscles of the lumbar region of the back through their entire seventy-two degree range of motion.

These and other objects and advantages of the present invention will become readily apparent as the invention is better understood by reference to the accompanying drawings and the detailed description that follows.

DESCRIPTION OF THE PREFERRED EMBODIMENT

Figure 1:
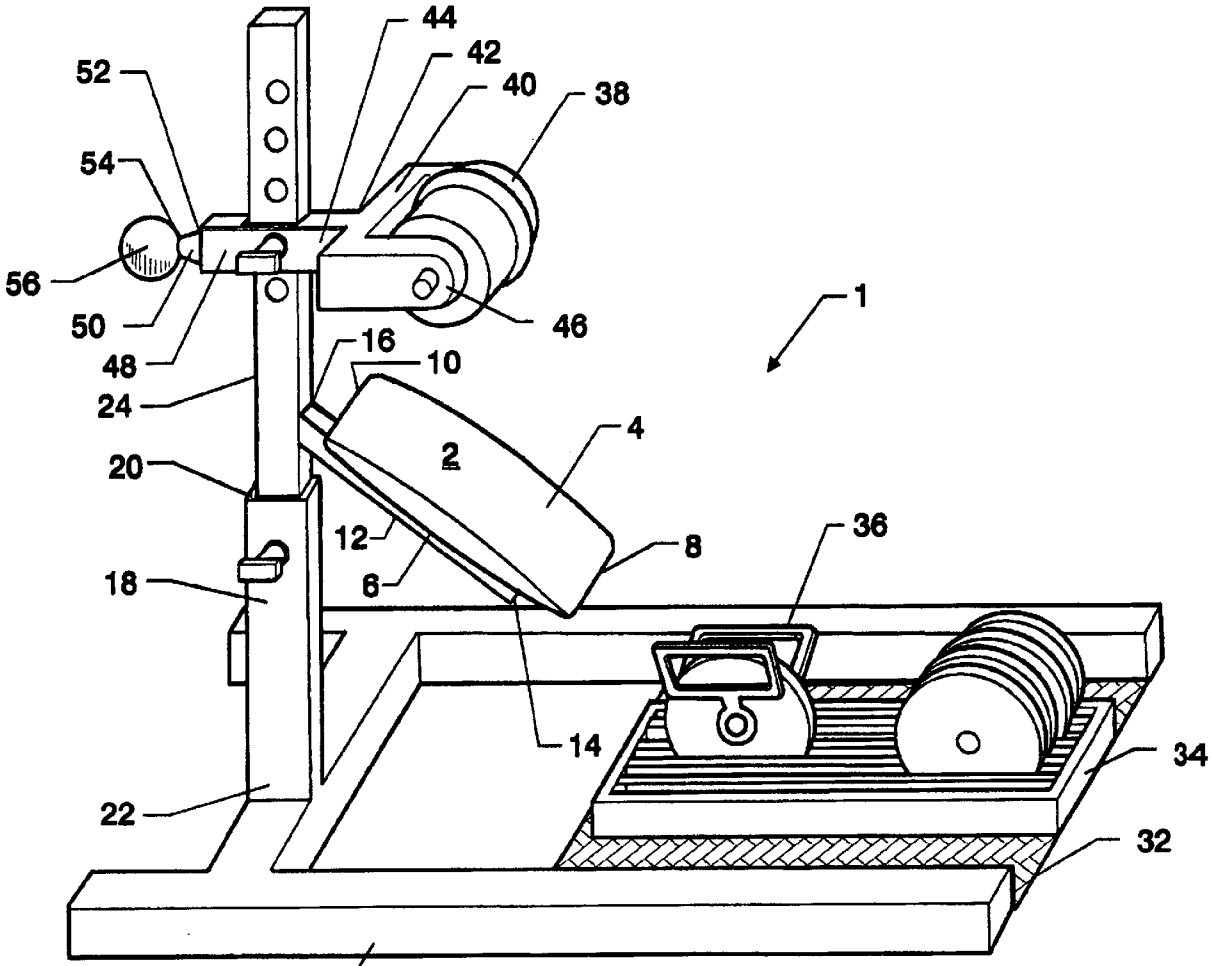
FIG. 1 is a schematic of a preferred embodiment of the present invention.

Referring now to the drawings wherein are shown preferred embodiments and wherein like reference numerals designate like elements throughout, there is shown in FIG. 1 a first preferred embodiment 1 of the present invention. It is seen to include a seat 2 having top 4, bottom 6, front 8 and rear 10 surfaces. The front 8 of the seat is of sufficient width so as to fully come into contact with the back of the top region of a sitting subject's legs.

In this preferred embodiment, the front of the seat is seen to be inclined to the horizontal at an angle in the range of fifteen to twenty-five degrees, or at an angle to the vertical of 65 to 75 degrees.

A seat base 12 is attached to the bottom 6 of the seat. This base 12 has a first end 14 that attaches to the seat near its front end 8. The base's second end 16 is attached to the apparatus' inner vertical support member 24 which slides in and out in a telescoping manner within the top 20 of a hollow cylinder that forms the apparatus' outer vertical support member 18 to allow the seat 2 to be fixed at various elevations above the top end 20 of the outer vertical support member.

A base 30 is attached to the bottom end 22 of the outer vertical support member 18 so as to provide vertical stability for the inner 20 and outer 18 vertical support members. This base 30 also includes a footplate 32 and a rack 34 to store the apparatus' weight resistance equipment, which takes the form of a hand-held weight 36 and a tray that includes additional weights which can be added to the hand-held weight, so that a subject may exercise with a variable resistance, hand-held weight 36.

The present invention further includes a cylindrical, variable diameter, roller pad 38 which is rotatably mounted to a roller pad base 40. This pad base has a first 42 and a second end 44, with the first end having two prongs 46 that extend from it so that the roller pad 38 may be rotatably mounted by its ends between the prongs 46. The pad base's second end 44 has extending from it a clamping means 48 that fits around the inner vertical support member 24 and allows the roller pad 38 to be fixed at various elevations above the seat 2.

When the present invention is used for strengthening a subject's lumbar extensor muscles, the apparatus' roller pad 38 is situated so that it contacts the pelvis and sacrum of the subject when he or she sits, then slides back by extending the knees so that the subject sits proximate the rear surface 10 of the seat. The advantage of this seat 2 and roller pad 38 orientation is that the contact of the roller pad 38 against a subject's pelvis and sacrum stabilizes the subject's pelvis, while eliminating hip movement so as to isolate the subject's lumbar extensor muscles while the subject exercises with the apparatus.

The apparatus' footplate 32 is used by a subject to press his or her feet against. This allows the subject to use the legs to push the hips rearward so that the subject's pelvis and sacrum stay in contact with the roller pad while the subject is exercising.

Figure 3:
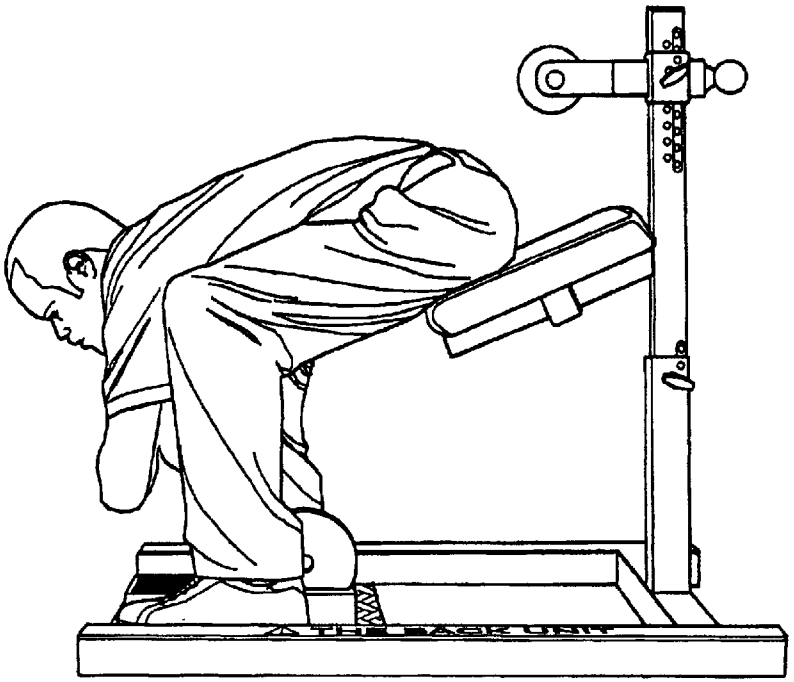
FIG. 3 is a drawing of this subject having bent over and assumed a first position with the subject's chest proximate his thighs, with the subject having picked up and holding against his chest a hand-held weight.
Figure 2:
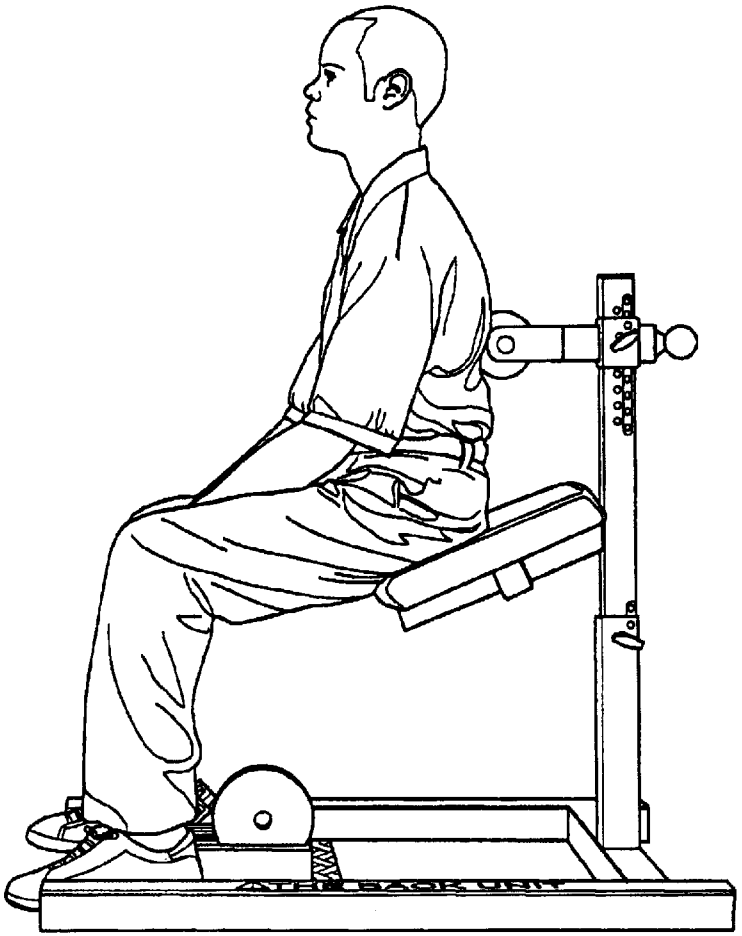
FIG. 2 is a drawing of the present invention with a subject sitting on its seat.
Figure 5:
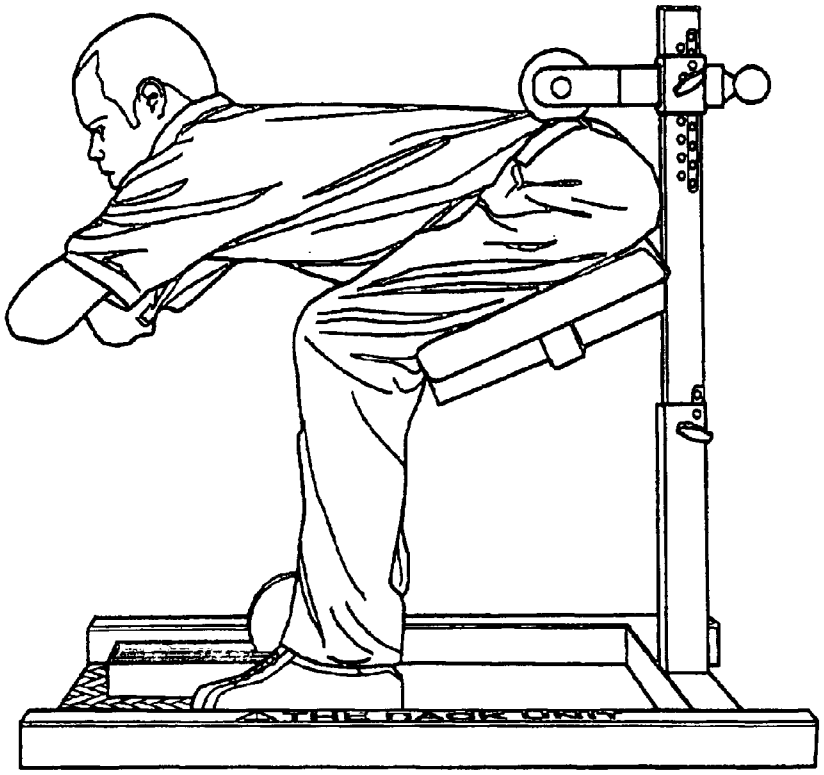
FIG. 5 is a drawing of the subject having extended his lumbar region to an approximately horizontal position while keeping his pelvis and sacrum in contact with the apparatus' roller pad and with the hand-held weight held near his chest.
Figure 4:
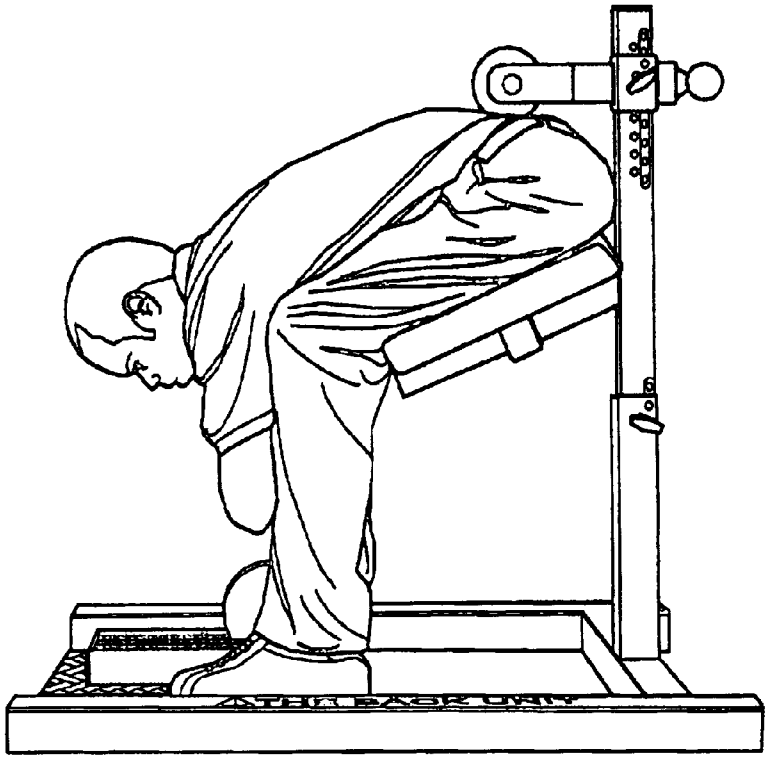
FIG. 4 is a drawing of the subject having used his legs to push his hips back so that his pelvis and sacrum are in contact with the apparatus' roller pad.
Figure 7:
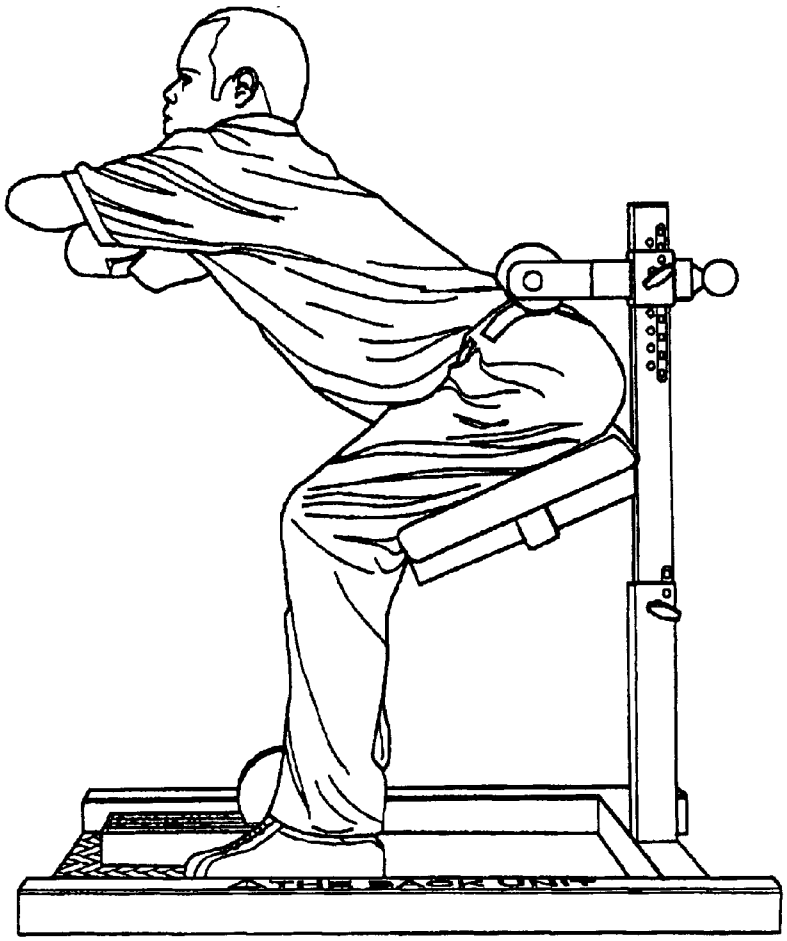
FIG. 7 is a drawing of the subject having raised his back to its maximum angular range of motion position, which is approximately seventy-two degrees.
Figure 6:
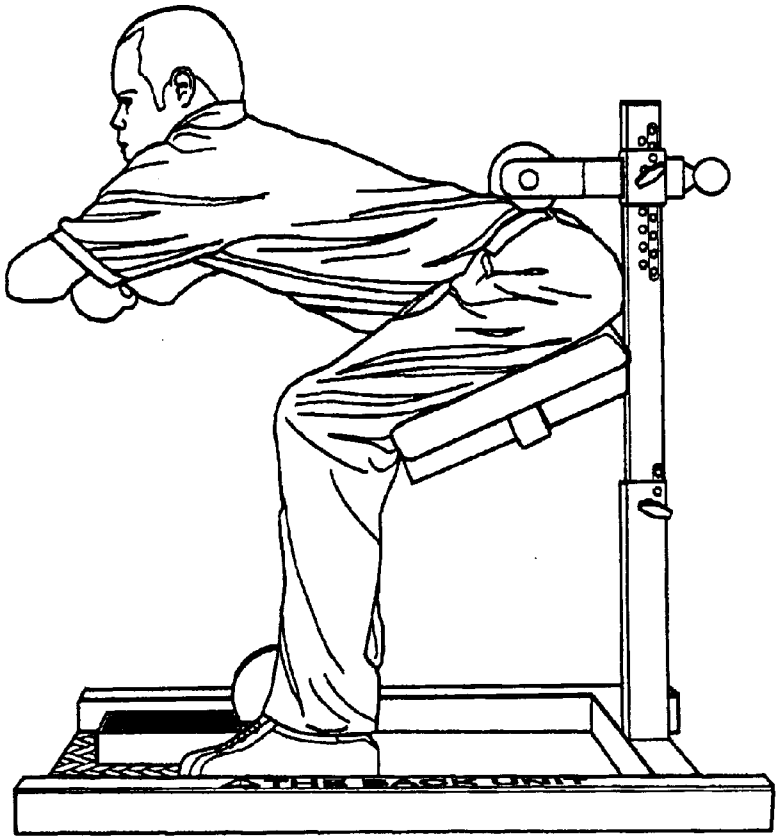
FIG. 6 is a drawing of the subject having extended his lumbar region still further to a position that is near its maximum angular range of motion from the back's initial position proximate the subject's thighs, with the subject's pelvis and sacrum always having been held in contact with the apparatus' roller pad and the hand-held weight held near his chest.

A preferred exercise for strengthening the lumbar region of a subject's lower back entails a subject sitting on the apparatus' seat, see FIG. 2, then assuming a first position with the subject's upper torso bent over so as to be proximate the subject's thighs, with a hand-held weight 36 having been grasped and held close to the subject's chest, see FIG. 3. The subject then pushes backward on the seat so that the subject's pelvis and sacrum are in contact with the roller pad, 38, see FIG. 4. The subject then moves to a second position by raising the subject's upper torso while holding the hand-held weight 36 near the subject's chest and keeping the subject's pelvis and sacrum in contact with the roller pad, 38, see FIGS. 5–7.

The angular range of motion of a human's lumbar region is found to be approximately seventy-two degrees. Exercising the entire range of motion has been found to be optimal for strengthening the lumbar (extensor) paraspinal muscles of the lower back. With the front of the seat downwardly inclined by 20 degrees, a subject can exercise the lumbar back muscles through an angular range of motion of 50 to 80 degrees, which includes a preferred seventy-two degrees range of angular motion.

Figure 8:
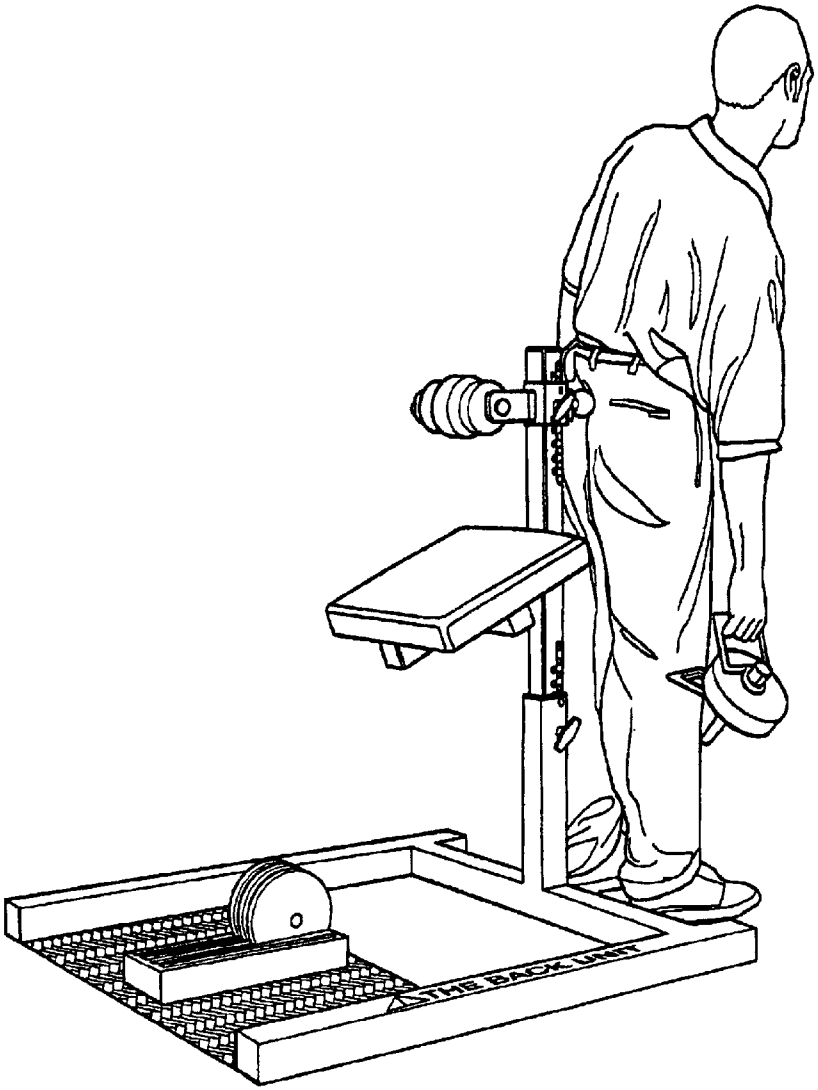
FIG. 8 is a drawing of the present invention with a subject standing and pressing his sacrum against the invention's knob while performing lateral flexion exercises.

In a second preferred embodiment, the present invention further includes an arm 50 which has a first end 52 that is attached to the clamping means 48 on the side opposite to that of the roller pad 38. The arm's second end 54 has attached to it a knob 56 that is so configured as to aid an exerciser, who stands with his/her sacrum against the knob 56, from moving his/her hips and pelvis while doing lateral, upper body bending exercises; see FIG. 8. Such exercises consist of a subject standing against the apparatus' knob 56 with the sacrum in contact with the knob 56 and the subject assuming a first position with the subject's upper torso bent laterally while holding a hand-held weight 36 in one hand near the subject's hip. The subject then moves to a second position by bending laterally in the opposite direction from the first position while keeping the sacrum in contact with the knob so as to restrict the movement of the pelvis.

Although the foregoing disclosure relates to a preferred embodiment of the invention, it is understood that these details have been given for the purposes of clarification only. Various changes and modifications of the invention will be apparent, to one having ordinary skill in the art, without departing from the spit and scope of the present invention.

We claim:

1. An apparatus for strengthening with exercises a subject's lumbar muscles, said apparatus comprising:

a seat having a width so that the top surface of said seat fully contacts the back of the sitting subject's legs, a vertical support member to which the back end of said seat is attached so that the centerline extending from the front to the back of said seat forms an angle with said vertical member in the range of 65 to 75 degrees with the front end of said seat being inclined downward to the surface on which said vertical support member stands, a base attached to the bottom end of said vertical support member, and a pad mounted to said vertical support member at a position above said seat, said vertical support member being hollow and having an open top end in which is fitted in a telescoping arrangement an enlongated, inner vertical suport member, said vertical support member further having a clamping means which allows the inner vertical member to be adjustably clamped to said vertical support member while the inner vertical member's top end is extended to one of a specified range of adjustable heights above said vertical support member, said seat being attached to said inner vertical member so as to allow said seat to be adjustably placed at a specified height above the surface on which said vertical member stands.

2. An apparatus as recited in claim 1, further comprising a pad base having a first end attached to said pad and a second end with a clamping means that allow said pad to be located at a specified position on said vertical support member and at a specified height above said seat.

3. An apparatus as recited in claim 1, further comprising a pad base having a first end attached to said pad and a second end with a clamping means that allow said pad to be located at a specified position on said vertical support member and at a specified height above said seat.

4. An apparatus as recited in claim 1, further comprising a footplate attached to said base and against which the feet of said sitting subject are placed so that said subject can use said subject's legs to push the hips of said subject rearward so that said subject's pelvis and sacrum stay in contact with said pad while said subject is performing said strengthening exercises.

5. An apparatus as recited in claim 3, further comprising a footplate attached to said base and against which the feet of said sitting subject are placed so that said subject can use said subject's legs to push the hips of said subject rearward so that said subject's pelvis and sacrum stay in contact with said pad while said subject is performing said strengthening exercises.

6. An apparatus as recited in claim 1, further comprising a hand-held weight which said subject grasps and holds near said subject's body while said subject is performing said strengthening exercises, wherein said base further having a means for holding and storing said hand weight when it is not in use.

7. An apparatus as recited in claim 3, further comprising a hand-held weight which said subject grasps and holds near said subject's body while said subject is performing said strengthening exercises, wherein said base further having a means for holding and storing said hand weight when it is not in use.

8. An apparatus as recited in claim 6, further comprising a hand-held weight which said subject grasps and holds near said subject's body while said subject is performing said strengthening exercises, wherein said base further having a means for holding and storing said hand weight when it is not in use.

9. An apparatus as recited in claim 2, further comprising a knob attached to said clamping means of said pad base, wherein said knob so configured as to aid said subject who stands with subject's sacrum against said knob from moving said subject's hips and pelvis while doing lateral, upper body bending exercises.

10. An apparatus as recited in claim 6, further comprising a knob attached to said clamping means of said pad base, wherein said knob so configured as to aid said subject who stands with subject's sacrum against said knob from moving said subject's hips and pelvis while doing lateral, upper body bending exercises.

11. An apparatus as recited in claim 10, further comprising a knob attached to said clamping means of said pad base, wherein said knob so configured as to aid said subject who stands with subject's sacrum against said knob from moving said subject's hips and pelvis while doing lateral, upper body bending exercises.

12. A method for strengthening a subject's lumbar muscles, said method comprising the steps of said subject:

using an exercise apparatus of the kind having a seat, a vertical support member to which the back end of said seat is attached so that the centerline extending from the front to the back of said seat forms an angle with said vertical member in the range of 65 to 75 degrees with the front end of said seat being inclined downward to the surface on which said vertical support member stands, a base attached to the bottom end of said vertical support member, a pad mounted to said vertical support member at a position above said seat, and a hand-held weight, sitting on said seat and assuming a first position with subject's upper torso bent over so as to be proximate said subject's thighs, grasping and holding near said subject's chest said hand-held weight, and moving to a second position by raising the subject's upper torso so that it moves through an angular range of motion in the range of 50 to 80 degrees while holding said hand-held weight near subject's chest and keeping the subject's pelvis and sacrum in contact with said pad.

13. A method for strengthening a subject's lumbar muscles as recited in claim 12, wherein said angular range of motion in the range of 65 to 75 degrees.

14. A method for strengthening a subject's lumbar muscles as recited in claim 12, wherein said exercise apparatus further comprising a footplate attached to said base and against which the feet of said sitting subject are placed so that said subject can use said subject's legs to push the hips of said subject rearward so that said subject's pelvis and sacrum stay in contact with said pad while said subject is performing said strengthening exercises.

15. A method for strengthening a subject's lumbar muscles as recited in claim 13, wherein said exercise apparatus further comprising a footplate attached to said base and against which the feet of said sitting subject are placed so that said subject can use said subject's legs to push the hips of said subject rearward so that said subject's pelvis and sacrum stay in contact with said pad while said subject is performing said strengthening exercises.

16. A method for strengthening a subject's lateral flexor muscles, said method comprising the steps of said subject:

using an exercise apparatus of the kind having a seat, a vertical support member to which the back end of said seat is attached so that the centerline extending from the front to the back of said seat forms an angle with said vertical member in the range of 65 to 75 degrees with the front end of said seat being inclined downward to the surface on which said vertical support member stands, a base attached to the bottom end of said vertical support member, a pad, a pad base having a first end attached to said pad and a second end with a clamping means that allow said pad to be located at a specified position on said vertical support member and at a specified height above said seat, a knob attached to said clamping means of said pad base, and a hand-held weight, grasping and holding near said subject's hip said hand-held weight, assuming a first position with said subject standing with subject's sacrum against said knob, moving to a second position by bending laterally while keeping said subject's sacrum in contact with said knob, wherein said knob so configured as to aid said subject who stands with subject's sacrum against said knob from moving said subject's hips and pelvis while doing said lateral, upper body bending exercises.

* * * * *